United States Patent [19]

Tolaas

[11] 4,048,052

[45] Sept. 13, 1977

[54] RECLOSEABLE CARTON

[75] Inventor: William M. Tolaas, St. Paul, Minn.

[73] Assignee: Hoerner Waldorf Corporation, St. Paul, Minn.

[21] Appl. No.: 765,227

[22] Filed: Feb. 3, 1977

[51] Int. Cl.[2] ..... B65D 5/54; B65D 5/68; B65D 17/24

[52] U.S. Cl. ..... 206/625; 229/44 CB

[58] Field of Search ..... 229/51 TC, 44 CB

[56] References Cited

U.S. PATENT DOCUMENTS

| | | | |
|---|---|---|---|
| 2,963,214 | 12/1960 | Leone et al. | 229/44 CB |
| 3,283,991 | 11/1966 | Hughes | 229/51 TC |
| 3,338,505 | 8/1967 | Hughes | 229/51 TC |
| 3,426,956 | 2/1969 | Frohlicher | 229/51 TC |
| 3,608,812 | 9/1971 | Hamilton | 229/44 CB |
| 3,893,614 | 7/1975 | Meyers | 229/51 TC |
| 3,910,487 | 10/1975 | Jaeschke | 229/51 TC |
| Re. 26,185 | 4/1967 | Henry | 229/51 TC |
| Re. 26,471 | 10/1968 | Meyers | 229/51 TC |

FOREIGN PATENT DOCUMENTS

| | | | |
|---|---|---|---|
| 1,384,751 | 11/1964 | France | 229/51 TC |

*Primary Examiner*—Davis T. Moorhead
*Attorney, Agent, or Firm*—Jerry F. Best

[57] ABSTRACT

A paperboard carton having a hinged or a flip top cover which extends down over the top of the carton and which has a double thickness front skirt with a slit extending across the center of the skirt, this slit positioned to overlie in the folded position a turned bound locking flange which is formed as a part of the front panel of the carton.

2 Claims, 9 Drawing Figures

RECLOSEABLE CARTON

BACKGROUND OF THE INVENTION

1. Field of the Invention

This disclosure relates generally to cartons having a hinged top cover and more particularly to those cartons which have a hinged top cover that has a skirt portion which extends below the top surface of the carton and which has means for locking the lid or cover in position when closed.

2. Description of the Prior Art

Reclosable cartons are common and are used for such products as cigarettes or ice cream or where the product which is contained in the carton is not used all at once. Typical examples of reclosable cartons which have a locking feature involving the front skirt of the lid are to be found in U.S. Pat. No. 3,283,991 to Hughes issued Nov. 8, 1966, U.S. Pat. No. 3,338,505 to Hughes issued Aug. 29, 1967, U.S. RE. No. 26,185 to Henry issued Apr. 4, 1967 and U.S. RE. No. 26,471 to Meyers issued Oct. 1, 1968.

With the exception of the Meyers patent, all have a locking flange affixed flush with the outer surface of the front panel which is undesireable for larger cartons. The interaction of the locking members is less positive where greater flexing of the panels can occur.

The Meyers patent employs a perforated locking panel which separates but leaves a rough edge and still results in one of the locking edges, the one connected to the cover, being affixed flush with the cover skirt which is less effective. There is a need for such a carton having a more positive locking feature.

SUMMARY OF THE INVENTION

A reclosable carton with a locking feature and blank for producing same wherein the cover has a depending skirt portion and a double thickness front panel with a slot extending across the inner thickness which engages a downwardly folded flange hingedly connected but not glued to the top edge of the front panel of the carton.

DETAILED DESCRIPTION OF THE PREFERRED EMBODIMENT

Figure 1:
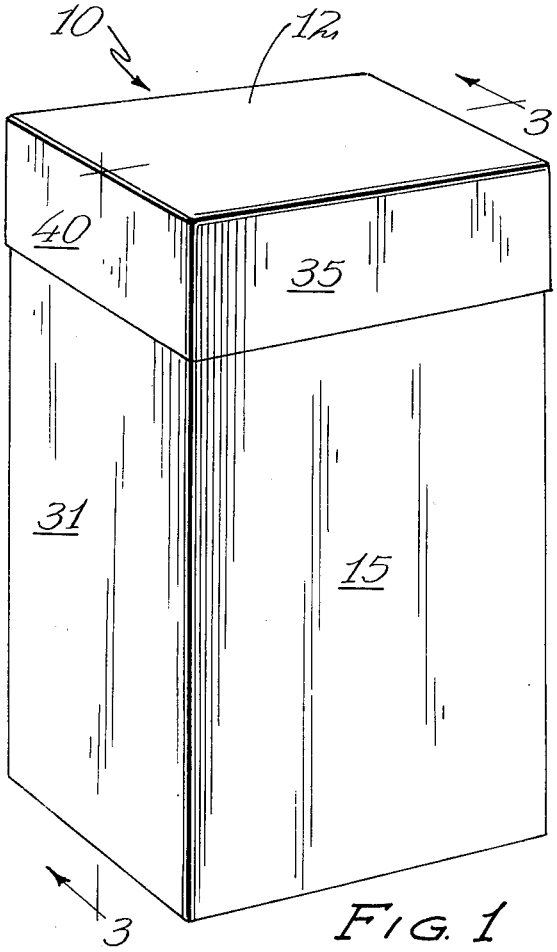
FIG. 1 is a perspective view of a carton completely assembled and closed embodying the present invention.
Figure 3:
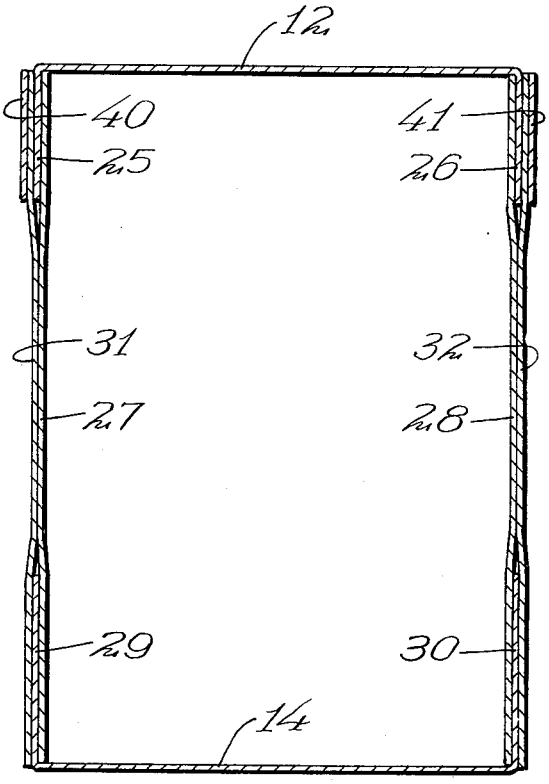
FIG. 3 is a back elevation section view of the container of FIG. 1 taken along section lines 3–3 in FIG. 1.

This invention relates to a carton 10 of a general rectangular carton. The carton is erected from a blank such as that shown in FIG. 6 which is assembled and erected into a carton which is side loaded since the top closure is in sealed position after the blank is glued and folded into its collapsed configuration. The blank is shown generally as 11 and includes a top panel 12, a back panel 13, a bottom panel 14 and a front panel 15 which are rectangular in shape and are attached to one another along connecting horizontal hinge lines 16, 17 and 18, respectively. The sides of these panels comprise parallel vertical edges and are defined by vertical fold lines 19 and 20.

Along these lateral edges are hingedly attached closure flaps for the sides of the carton and include minor flaps 25 and 26 attached on either side of the top panel 12; major flaps 27 and 28 attached on either side of the back panel 13; minor flaps 29 and 30 attached to either side of the bottom panel 14 and major flaps 31 and 32 attached to either lateral side of the front panel 15. To the exposed edge of the front panel 15, which is the top edge in the erected position, is attached along a hinge line 33 a locking flange 34. At the opposite end of the blank is a flange assembly including a top cover flange outer wall 35 connected along a hinge line 36 to the top panel 12 and in turn connected thereto is the top cover depending skirt inner section 37 connected along the hinge line 38 and having formed therein a slit or line cut 39 which will be described later. On either lateral edge of the top cover front flange outer section 35 are two tabs 40 and 41 which make up a portion of the depending skirt attached to the top panel 12. It can be seen that the flange 35 and these tabs 40 and 41 have an area of adhesive 42 positioned on the side closest to the top 12 of the carton in its final configuration.

The major flaps 31 and 32 have a separable section 31A and 32A formed therein at the end which is adjacent the top of the carton in final folded position. These sections 31A and 32A serve to hold the carton together before it is opened but must be removable so as to rotate with the cover when the carton is opened. As seen best in FIG. 2 the outside of the minor flaps 25 and 26 are glued to the removable portion of the side panels 31A and 32A, respectively. The combination line cuts and frangible score lines 31B and 32B as well as the portion of the score lines 19 and 20 which form the lateral edge of the sections 31A and 32A.

Figure 6:
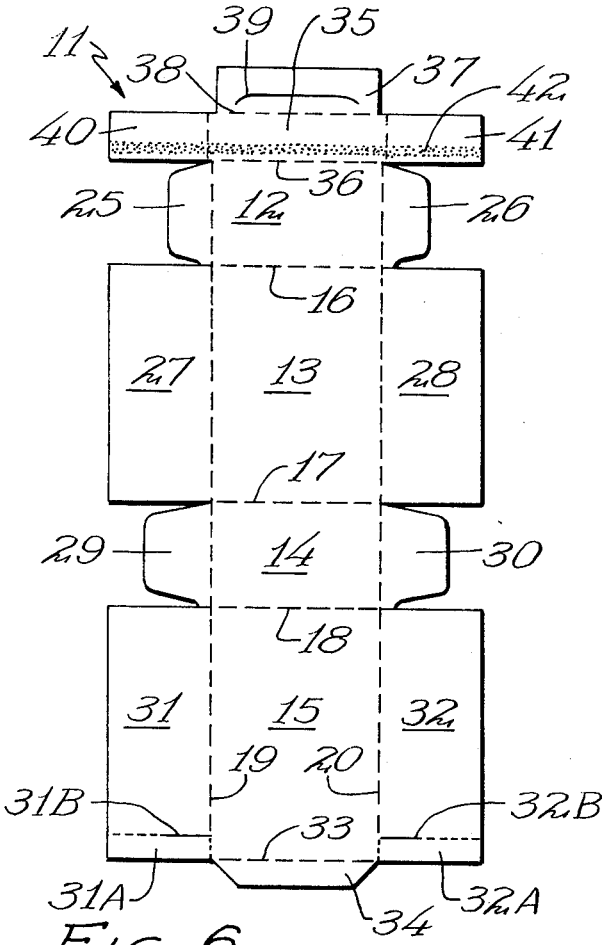
FIG. 6 is a plan view of a blank adapted to be folded into a carton such as that shown in FIG. 1.
Figure 7:
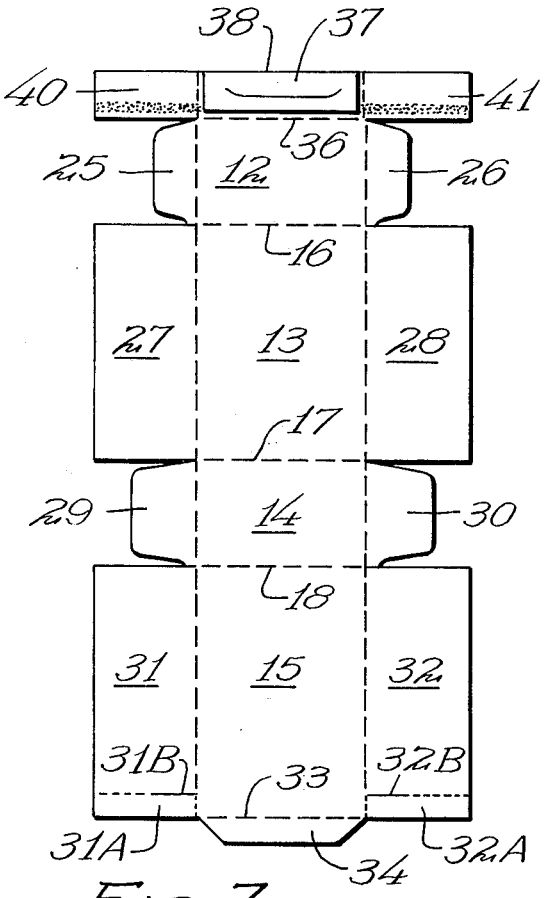
FIG. 7 illustrates the first step in the folding of the blank shown in FIG. 6.
Figure 8:
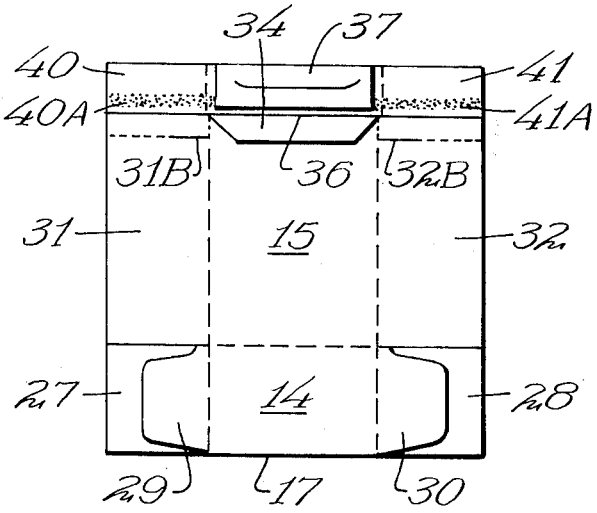
FIG. 8 illustrates the next sequential step in the erection of the blank of FIG. 6.
Figure 9:
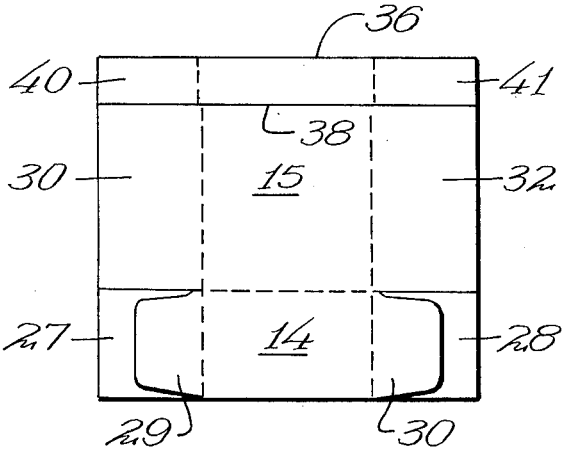
FIG. 9 shows the blank of FIG. 6 in its final collapsed configuration ready for shipment.

In FIGS. 6 through 9 the gluing and folding sequence is described and as can be seen the initial step is the application of adhesive 42 across the tabs 40, 41 and the section 35 as shown in FIG. 6 as stippling. The flange inner section 37 is folded about the fold line 38 so that it is adhesively attached to the outer skirt section 35 but so the slit 39 is not involved as shown in FIG. 7. Next the blank is folded about the hinge line 17 as shown in FIG. 8, appearing as stippling on the drawing. Next the top part of the blank is folded downwardly about the hinge line 36 into the collapsed configuration shown in FIG. 9.

Figure 2:
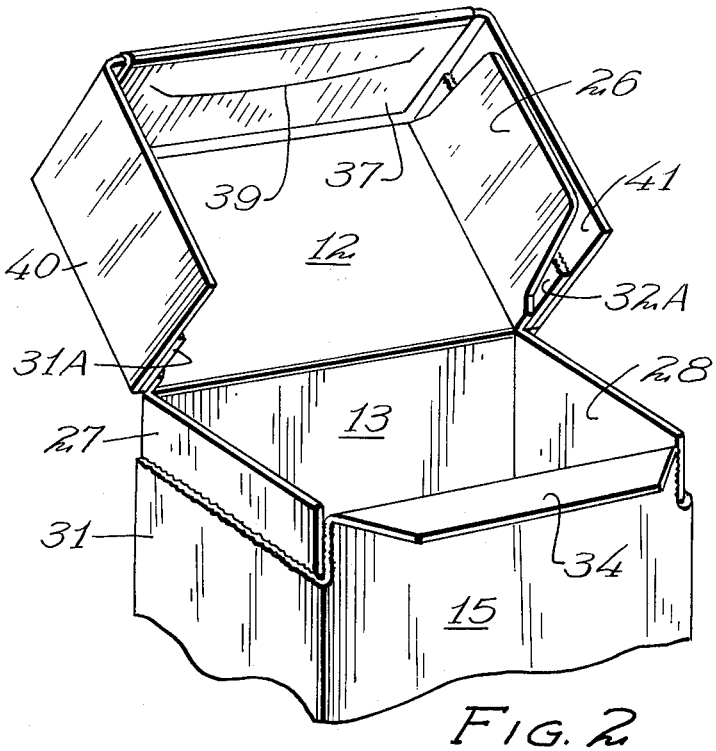
FIG. 2 is a perspective view of the top of the carton of FIG. 1 shown with the cover in open position.
Figure 4:
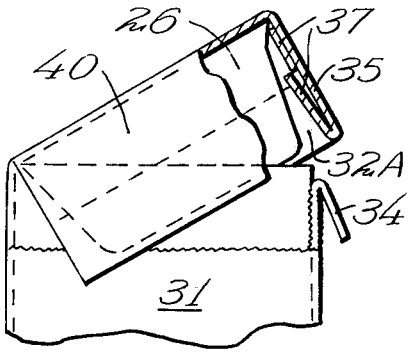
FIG. 4 is a side elevation section view through the same section as FIG. 3 illustrating the relative position of the components of the closure in open position.
Figure 5:
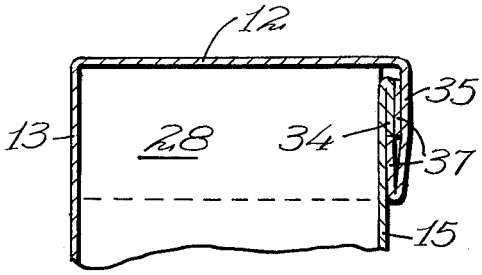
FIG. 5 is a side elevation section view showing the same closure as in FIG. 4 but in closed position illustrating the inner action of the locking feature.

The carton is side loaded and the end or side closure flap are then placed in position and glued with the large flap 27 or 28 being fodled first, the minor flaps being folded intermediate to the major flaps, and the major flap 31 or 32, which now has the tab 40 or 41, respectively attached to it being the outer folded flap. As seen in FIGS. 4 and 2, when the carton is opened the removable portions 31A and 32A are broken away and the cover rotated upwardly about the fold line 16. The side skirt portions of the cover remain intact since the tabs 40 or 41 are glued to the removable sections 31A or 32A, respectively, and are in turn attached to the minor flaps 25 or 26.

It may be seen in FIG. 2 that the downwardly extending front flange 34 is not attached to the front of the carton 15 and the natural resilience of the fibres result in a tendency for the flange 34 to be positioned out from the front of the carton as seen in FIG. 4. This is important since there is a greater likelihood of positive engagement with the slit 39 in the inner section 37 and more stability in the closed position, particularly in larger cartons.

I claim:

1. A blank made of foldable paperboard erectable into a reclosable flip top carton having a locking cover, said blank comprising;

a substantially rectangular sheet of said paperboard defined by parallel horizontal top and bottom edges and parallel vertical side edges;

three horizontal spaced apart hinge lines intermediate said top and bottom edges defining, respectively, a top panel, a back panel, a bottom panel, and a front panel;

minor closure flaps hingedly attached along the side edges of said top and bottom panels;

a flange assembly hingedly connected to said top edge of said blank including a rectangular top cover front flange connected to said top panel, a tab connected along each lateral edge of said front flange, and a top cover depending inner skirt section hingedly connected to the top edge of said front flange;

said skirt section having formed therein a transverse slit extending substantially horizontally intermediate the lateral edges thereof;

a locking flange hingedly connected to the bottom edge of said blank;

major flaps connected to the lateral edges of said back panel and extending the length thereof;

major flaps connected to the lateral edges of said front panel; and a removable section formed in each of said front panel major flaps defined by frangible score lines positioned horizontally near the bottom of said flaps and a frangible vertical score line near the bottom of the hinge lines connecting said major flaps to said front panel.

2. A closure for a rectangular paperboard carton having front, back, and side panels, said side panels having a narrow removable portion near the top edge thereof, comprising:

a hinged locking flange connected along the top edge of said front panel and folded outwardly and downwardly;

a top cover panel hingedly connected along the top edge of said back panel and formed to substantially the same dimensions as the top opening of said carton;

said top panel having downwardly extending flaps connected along the lateral edges thereof and positioned on the outer surfaces of said side panels;

said top panel having a front flange connected along the front edge thereof and depending downwardly beyond the top edge of said front panel;

said front flange having tabs connected to the side edges thereof and positioned along the outer surfaces of said side panels and adhesively attached to the top removable portion thereof; and an inner skirt flange attached to the inner surface of said front flange and having a slit formed therein positioned to engage the exposed edge of the downwardly extending locking flange.

* * * * *